US005344021A

United States Patent [19]

Rose

[11] Patent Number: 5,344,021

[45] Date of Patent: Sep. 6, 1994

[54] MOLDED CRATE WITH INTERLOCKING RIM APPLIANCES

[75] Inventor: Henry H. Rose, Knoxville, Tenn.

[73] Assignee: Formall, Inc., Knoxville, Tenn.

[21] Appl. No.: 125,032

[22] Filed: Sep. 21, 1993

[51] Int. Cl.[5] ..... B65D 21/00

[52] U.S. Cl. ..... 206/505; 206/507; 220/23.4

[58] Field of Search ..... 206/504, 505, 507; 220/23.4, 23.6

[56] References Cited

U.S. PATENT DOCUMENTS

| | | | |
|---|---|---|---|
| 1,826,080 | 10/1931 | Lockwood . | |
| 2,738,893 | 3/1956 | Quinones, Jr. | 220/23.4 |
| 2,823,829 | 2/1958 | Frater | 206/507 |
| 2,987,198 | 6/1961 | Crane . | |
| 3,343,706 | 9/1967 | Berend | 220/23.4 |
| 3,547,309 | 12/1970 | Pusey et al. . | |
| 3,734,309 | 5/1973 | Bateman . | |
| 3,734,341 | 5/1973 | Levenhagen | 206/507 |
| 3,760,937 | 9/1973 | Van Wyngarden et al. . | |
| 4,067,475 | 1/1978 | Pinkau et al. . | |
| 4,079,077 | 3/1978 | David . | |
| 4,139,098 | 2/1979 | Mollon | 206/507 |
| 4,387,824 | 6/1983 | Wefers | 220/23.4 |
| 4,619,363 | 10/1986 | Wolfseder . | |
| 4,886,239 | 12/1989 | Stimmel | 206/504 X |

FOREIGN PATENT DOCUMENTS

| | | |
|---|---|---|
| 790060 | 9/1935 | France . |
| 2185963 | 8/1987 | United Kingdom . |

*Primary Examiner*—Steven M. Pollard

*Attorney, Agent, or Firm*—Luedeka, Neely & Graham

[57] ABSTRACT

A shipping crate suitable for containing loose materials and for vacuum molded fabrication from thermo-formable polymer materials is constructed with denticulated end walls for alternative column stacking or nesting. Spades and receptacles in side and end walls, respectively, are spaced for meshing and interlocking laterally adjacent containers in parallel columns. End wall denticulations provide column stacking support surfaces above the crate contents when alternate end stacked and nest stacking when ends with the same dentil sequence are vertically aligned.

10 Claims, 3 Drawing Sheets

MOLDED CRATE WITH INTERLOCKING RIM APPLIANCES

BACKGROUND OF THE INVENTION

1. Field of the Invention

The present invention relates to improvements in containers generally characterized as crates, totes, bins, or baskets.

2. Description of the Prior Art

Molded crates or tote bins as they are frequently called, usually have a greater utility life than those made of wood. Although more expensive than wood, when used on a closed shipping circuit which allows a considerable measure of reuse, advantage may be taken of the material durability.

Open top containers of this type have found utility in a myriad of industries and activities such as agriculture and manufacturing.

In addition to material toughness and durability, desirable design characteristics of such utility crates include empty nesting capacity, protection of the crate contents from vertical stacking loads and the ability to interlock a multiplicity of such crates in adjacent, vertical stacks on a typical wood shipping pallet for transport stability by floor jacks and forklift vehicles.

It is therefore an object of the present invention to teach the construction of an integral, vacuum molded poller container having group interlocking appliances. Another object of the present invention is to teach a polymer crate design that can be selectively nested when empty and column loaded when full without imposing stacking loads on the crate contents.

Another object of the invention is to teach the construction of a one-piece stacking/nesting polymer crate of integral molded construction having no accessory or external components. Another object of the present invention is to each the construction of a one piece molded polymer crate that can be interlocked with identical adjacent crates in the same stacking tier.

SUMMARY OF THE INVENTION

These and other objects of the invention to be subsequently made apparent are accomplished by a molded polymer crate having denticulated end walls and a rectangular rim band around the top edges of the sidewalls and the two denticulated end walls. Spade elements are cut into the upper edge of the rim band above a sidewall and an end wall. Receptacles for interlocked accommodation for such spades are molded into the perimeter rim above the other side wall and the other denticulated end wall.

The end wall denticulations each include a one and one half square wave. However, one wall of the crate comprises a single dentil flanked by two channels whereas the other end wall Comprises two dentils separated by a single channel. When the end walls of several such crates are vertically aligned, the crates may be nested into the-empty internal volume of the crate below. If reversed, however, and crate orientation alternated with respect to vertically adjacent end wall deticulations, each crate is supported by a three point suspension area.

BRIEF DESCRIPTION OF THE DRAWINGS

Relative to the drawings wherein like reference characters designate like or similar elements throughout several figures of the drawing.

DESCRIPTION OF THE PREFERRED EMBODIMENT

Figure 1:
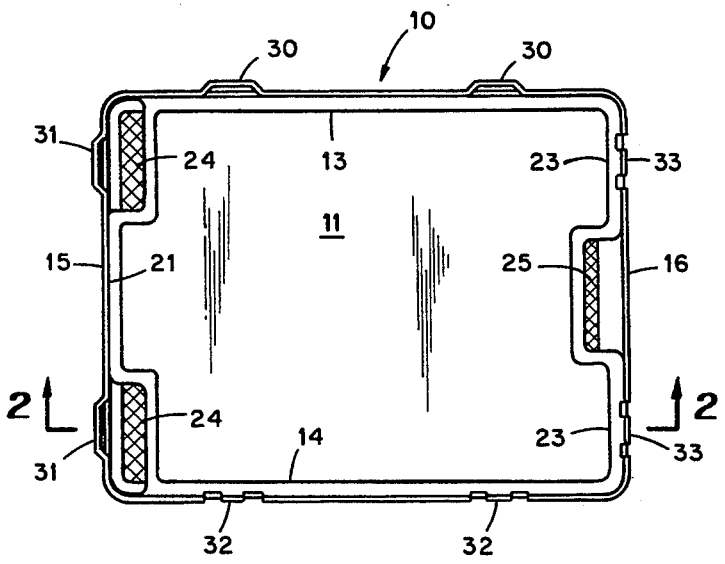
FIG. 1 is a top plan view of the present invention.
Figure 2:
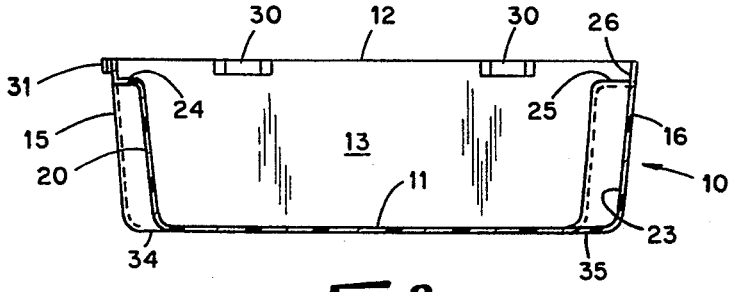
FIG. 2 is a sectional side elevation of the present invention as viewed along the cutting plane 2—2 of FIG. 1.
Figure 3:
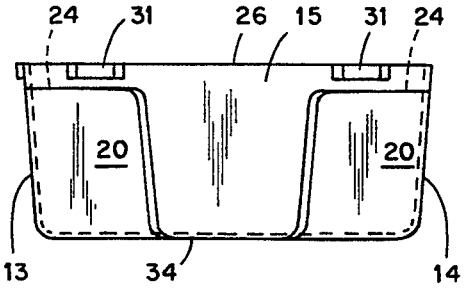
FIG. 3 is an end view of that end wall having only one dentil separating two dentil channels.
Figure 4:
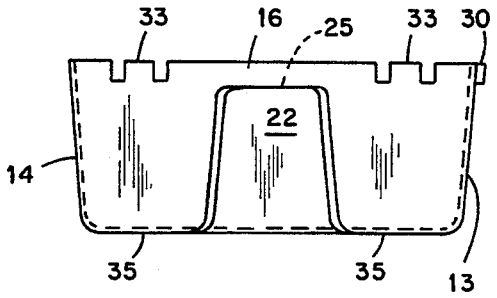
FIG. 4 is an end elevation of that end wall having two dentils separated by a single channel.

The present invention is an article that is intended to be vacuum molded from high density polyethylene or polyvinyl chloride. The crate wall thickness will usually depend on the container size and rated load capacity for the crate. However, the fact that the present invention is most suitably practiced by vacuum moldable, thermoformable materials such as high density polyethylene or polyvinyl chloride does not preclude fabrication by other materials such as stamped steel or fiber glass; whether molded or hand laid.

Relative to FIGS. 1, 2, 3 and 4 collectively, a crate 10 is seen as comprising two sidewalls 13 and 14, two end walls 15 and 16, and a bottom panel 11. These five surfaces bound an internal volume below an open top area 12.

End walls 15 and 16 are distinctive by their denticulated shape whereby wall 15 comprises a dentil salient 21 flanked by two dentil channels 20. End wall 16 is formed to the opposite pattern including two dentil salients 23 separated by a dentil channel 25. All of these dentil elements are two axis tapered to facilitate nesting as will hereafter be described. Surrounding the upper edge of the crate walls is a rectangular perimeter band 26. Receptacle openings 30 are formed from the rim material above sidewall 13. Similarly, receptacle openings 31 are formed from the rim material above end wall 15. Spades 32 are formed by flanking notches in the rim material above sidewall 14. Spades 33 are formed from the perimeter rim above end wall 16.

Figure 6:
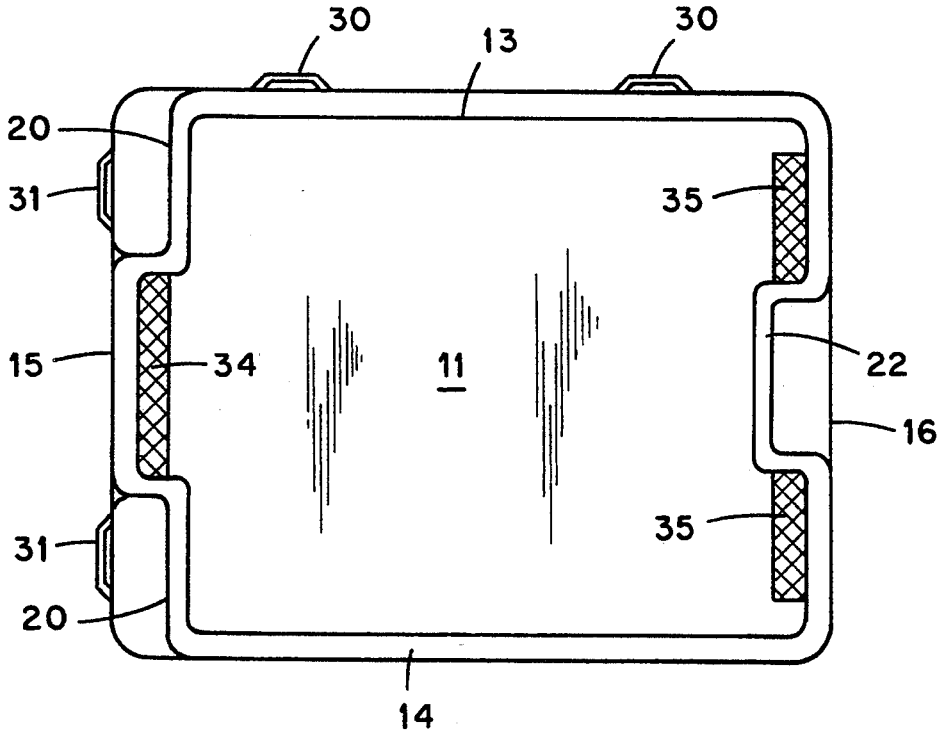
FIG. 6 is a bottom plan view of the present invention.

Cross hatched areas 24 represent upwardly facing load bearing areas above the dentil channels 20. Similarly, cross hatched area 25 is an upwardly facing load area above dentil channel 22 and end wall 16. With reference to the bottom plan of FIG. 6 it will be seen that load bearing area 34 is located below the dentil salient 21. Likewise, down facing load areas 35 are below the dentil salients 23.

Figure 5:
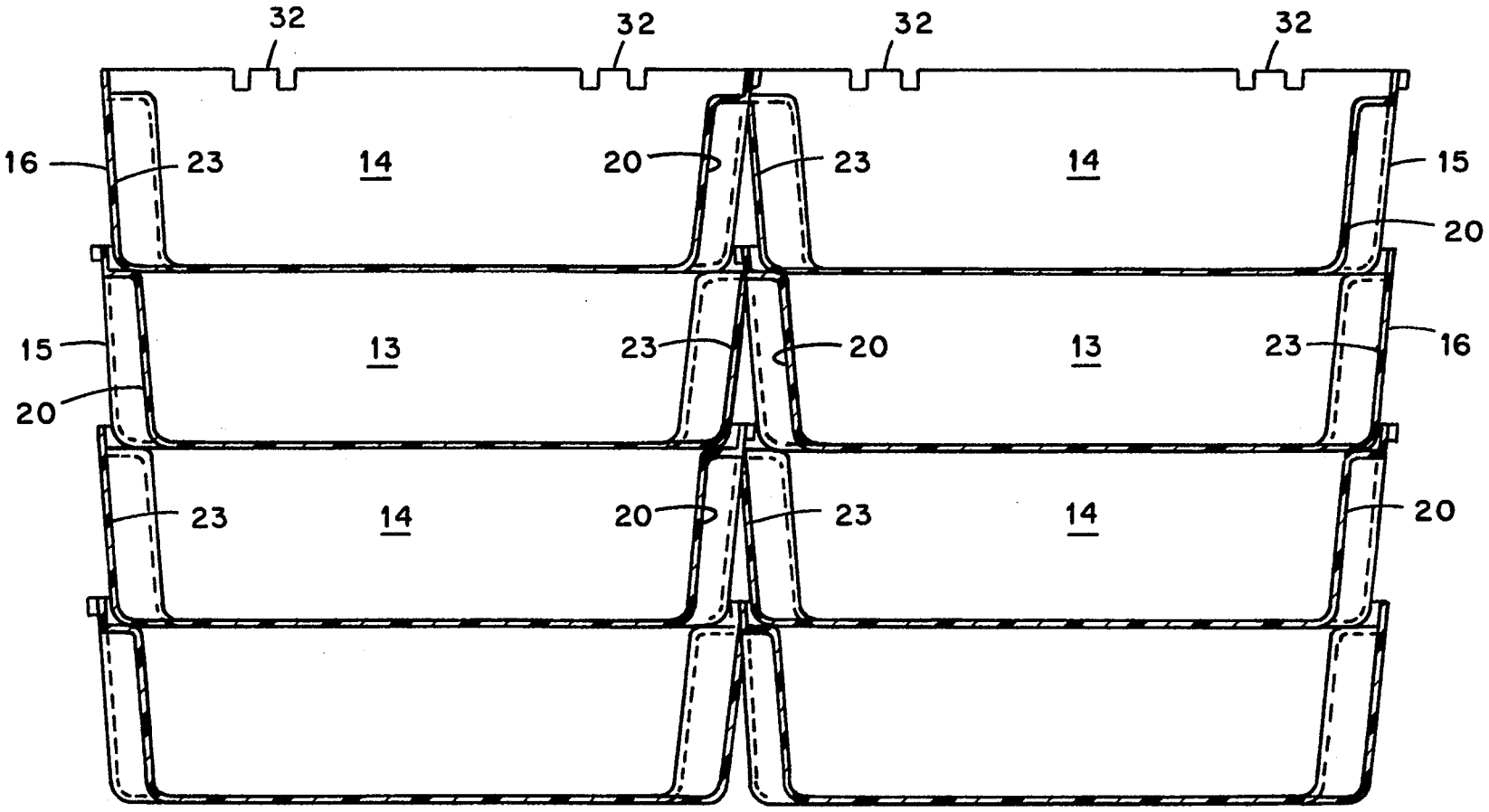
FIG. 5 is a sectional elevation of a stacked assembly of 8 crates typical to the present invention.

In use, this crate is vertically stacked in columns as shown by FIG. 5 with the end wall 16 aligned above the end wall 15 of a lower crate. This arrangement places the two bottom facing load areas 35 into face-to-face contact with the two up facing load areas 24. Similarly, the one down facing load area 34 in end wall 15 directly engages the one up facing load area 25 in end wall 16 of the lower crate.

This alternating end wall alignment is repeated vertically as a column of crates rises.

To unitize and laterally stabilize two or more crate columns, the rim spades are meshed with adjacent receptacle openings. This interlock may be repeated at each crate tier of the rising columns.

It will also be noted that the rim 26 rises above the up-facing support surfaces 24 and 25 to laterally confine the crate bottoms.

Figure 7:
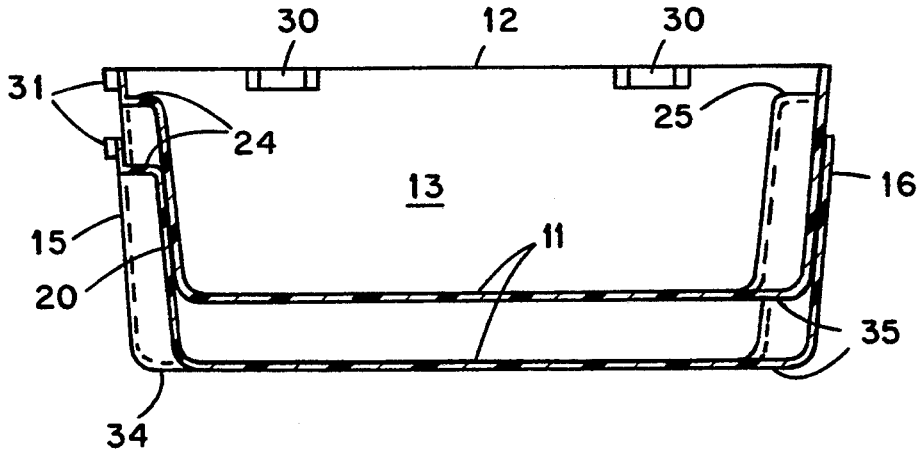
FIG. 7 is a sectional elevation of a nested assembly of two crates according to the invention.

To conserve space when empty crates are returned to a loading point, they may be nested in the manner illustrated by FIG. 7 wherein denticulated end walls 15 and 16 of an upper crate are vertically aligned with end walls 15 and 16 of a lower crate. In this alignment the upper crate bottom may be keyed into the lower crate internal volume.

Having fully disclosed my invention, those of ordinary skill in the art will note obvious variations and equivalencies within the spirit of the invention. As my invention, therefore,

I claim:

1. A utility crate of integrally molded, unitary construction having a pair of end walls, a pair of side walls and a bottom panel bounding an interior container volume; an open top area above said interior volume; vertical stacking support surfaces disposed on said end walls outside of said open top areas to support another, superposed crate above said interior volume; a perimeter band having substantially straight, planar sections upstanding from said side and end walls surrounding said open top area and outside of said support surfaces whereby said support surfaces are disposed between said perimeter band and said open top area and said perimeter band laterally confines said superposed crate on said stacking support surfaces; first sections of said perimeter band above one of said end walls and one of said side walls having spade elements projecting upwardly therefrom, second sections of said perimeter band above said other end wall and said other side wall having spade receptacle elements, said space and receptacle elements having substantially identical relative spacing whereby the side wall spade elements of a first crate may be meshed with the side wall receptacle elements of a second crate positioned laterally adjacent said first crate.

2. A utility crate as described by claim 1 wherein said end walls are denticulated below said perimeter band whereby one end wall has a central external channel below said perimeter band which opens through said bottom panel and the other end wall has a central external salient.

3. A utility crate as described by claim 2 having a bottom planform wherein a second such crate will nest within the interior volume of a first such crate when the one end wall of said second crate is aligned above the one end wall of the first crate.

4. A utility crate as described by claim 3 wherein said one end wall has a single up-facing load support area above said central channel and a pair of adjacently down-facing load support area of said bottom panel.

5. A utility crate as described by claim 4 wherein said other end wall has a pair of up-facing load support areas above said pair of external corner recesses and a single, down-facing load support area of said bottom panel below said external salient.

6. A utility crate of integrally molded, unitary construction having an internal volume bounded by a pair of substantially planar side walls, first and second denticulated end walls, a bottom panel and a continuous, substantially rectangular rim band having planar side and end sections projected integrally up from said side and end walls, one side and one end section of said rim band including planar spade elements formed within the respective planes thereof and receptacle elements formed within the other side and end section, said spade and receptacle elements being positioned and relatively spaced along said rim band for meshing engagement of receptacle elements respective to a first crate by spade elements respective to an adjacent second crate whereby said adjacent crate is secured from displacement from said first create in all directions substantially parallel with said bottom panel said first end wall comprising a central dentil flanked by adjacent channels, said second end wall comprising a pair of dentils separated by a central channel whereby a portion of a second such utility crate may be nested within the internal volume of a first such utility crate when respective first and second end walls are vertically aligned and said second utility crate is supported by said first utility crate above said first crate internal volume when said second crate first wall is vertically aligned with said first crate second wall.

7. A utility crate as described by claim 6 wherein said rim band end sections extend in a substantially straight line over said denticulated end walls in outer planes respective to said denticulations.

8. A utility crate as described by claim 6 wherein said receptacle elements are formed by the displacement of rim band material outwardly from the respective rim band plane.

9. A utility crate as described by claim 7 wherein said first end wall has a pair of up-facing load support areas above said dentil flanking channels within said rim band and a single down-facing load support area of said bottom panel below said dentil.

10. A utility crate as described by claim 9 wherein said second end wall has a single up-facing load support area above said single channel within said rim band and a pair of down-facing load support areas of said bottom panel respectively below said pair of dentils.

* * * * *